US006279519B1

(12) United States Patent
Nagel et al.

(10) Patent No.: US 6,279,519 B1
(45) Date of Patent: Aug. 28, 2001

(54) AIR AND WATER COOLED OPPOSED CYLINDER AIRCRAFT ENGINE

(76) Inventors: William S. Nagel, 1417 Sadler Rd., No. 104, Fernandina Beach, FL (US) 32034; Phillip L. Reid, 400 S. Danzler Rd., Duncan, SC (US) 29334-9530

( * ) Notice: Subject to any disclaimer, the term of this patent is extended or adjusted under 35 U.S.C. 154(b) by 0 days.

(21) Appl. No.: 09/784,456

(22) Filed: Feb. 15, 2001

(51) Int. Cl.[7] ..... F02B 33/10
(52) U.S. Cl. ..... 123/55.5
(58) Field of Search ..... 123/55.2, 55.4, 123/55.5, 55.6, 55.7, 41.57

(56) References Cited

U.S. PATENT DOCUMENTS

| | | | | |
|---|---|---|---|---|
| 688,349 | | 12/1901 | Scott et al. . | |
| 727,455 | | 5/1903 | Rumpf . | |
| 730,345 | | 6/1903 | Coburn . | |
| 785,229 | | 3/1905 | Risbridger . | |
| 1,282,824 | | 10/1918 | Hartson . | |
| 1,428,858 | | 9/1922 | Porter . | |
| 1,486,298 | | 3/1924 | Powell . | |
| 1,764,386 | | 6/1930 | Brockway . | |
| 2,076,892 | * | 4/1937 | Irgens | 123/55.6 |
| 2,234,900 | | 3/1941 | Jones . | |
| 2,253,490 | | 8/1941 | Bakewell . | |
| 2,290,936 | | 7/1942 | Bakewell . | |
| 3,194,222 | * | 7/1965 | Brown | 123/275 |
| 3,274,982 | | 9/1966 | Noguchi . | |
| 3,456,630 | | 7/1969 | Karlan . | |
| 4,215,660 | | 8/1980 | Finley . | |
| 4,305,349 | | 12/1981 | Zimmerly . | |
| 4,413,705 | | 11/1983 | Inaga . | |
| 5,778,834 | * | 7/1998 | Piccinini | 123/55.2 |
| 6,223,704 | * | 5/2001 | Chatelain | 123/55.2 |
| 6,240,887 | * | 6/2001 | Tosaka et al. | 123/55.5 |

* cited by examiner

*Primary Examiner*—Marguerite McMahon
(74) *Attorney, Agent, or Firm*—John V. Stewart

(57) ABSTRACT

An internal combustion piston engine with horizontally opposed cylinders. Each opposed pair of cylinders fires simultaneously, providing symmetric cranking force on the crankshaft 13. Each cylinder 1 is a simple solid of rotation with air-cooling fins 10. The cylinder heads 5 are modular. Each module covers two adjacent cylinders, and has liquid cooling channels. All cylinders are identical, and all cylinder heads are identical. The cylinders are held inward against the crankcase by the cylinder heads. Each cylinder head is held inward against the cylinders by two tension bolts 42 that span to the opposite cylinder head. One tension bolt crosses above the crankcase, and one below it. In a preferred 12-cylinder engine embodiment, each opposed pair of cylinders is separated from the other opposed pairs in spark timing by a sequence of 105 and 135 degrees that reduces torsional harmonic resonance in the crankshaft, eliminating harmonic balancers.

17 Claims, 20 Drawing Sheets

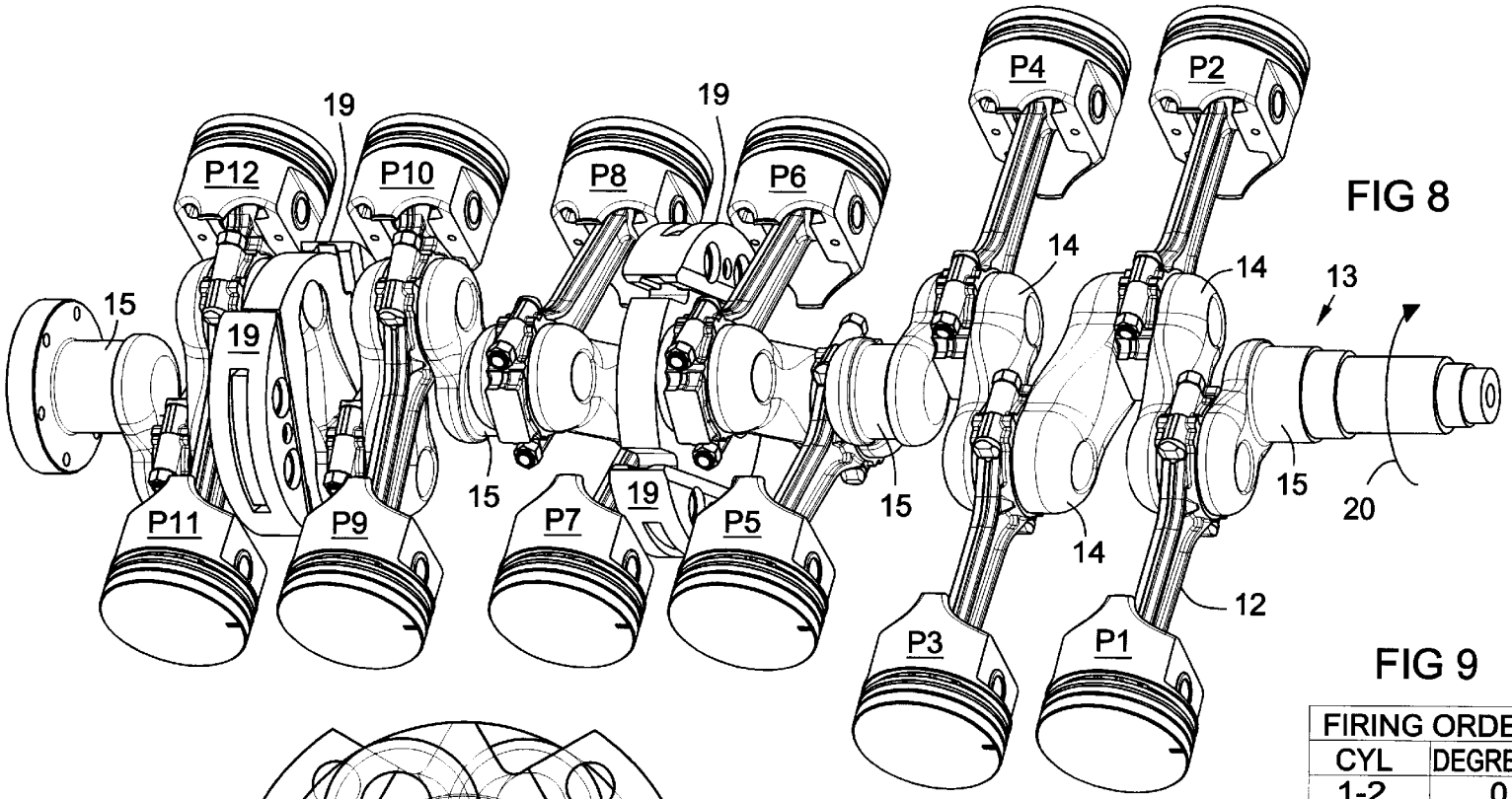
FIG 8
| FIRING ORDER | |
|---|---|
| CYL | DEGREES |
| 1-2 | 0 |
| 5-6 | 120 |
| 9-10 | 240 |
| 3-4 | 360 |
| 7-8 | 480 |
| 11-12 | 600 |
FIG 9
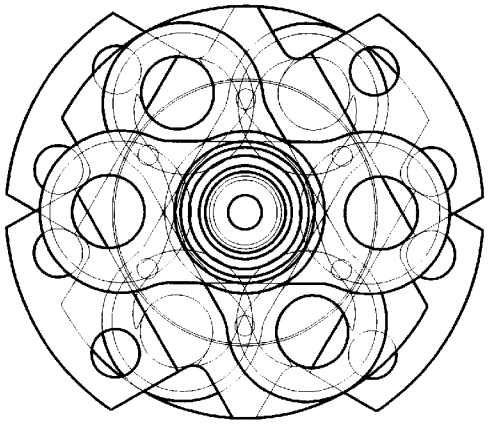
FIG 10

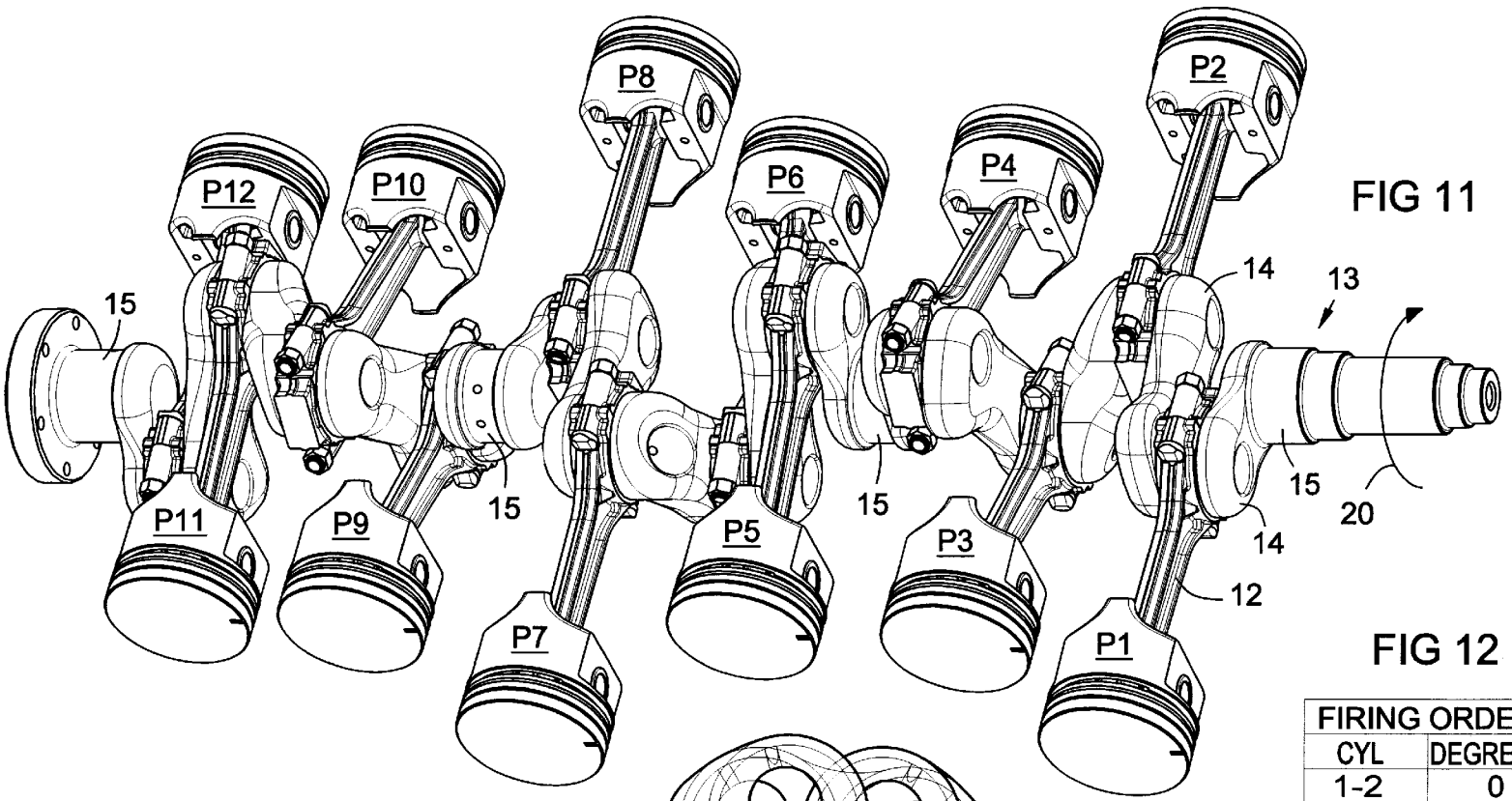
FIG 11
| FIRING ORDER | |
|---|---|
| CYL | DEGREES |
| 1-2 | 0 |
| 3-4 | 105 |
| 5-6 | 240 |
| 7-8 | 345 |
| 9-10 | 480 |
| 11-12 | 585 |
FIG 12
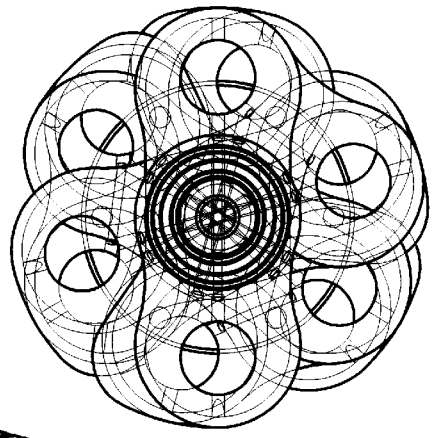
FIG 13

AIR AND WATER COOLED OPPOSED CYLINDER AIRCRAFT ENGINE

BACKGROUND OF THE INVENTION

1. Field of the Invention

This invention relates to truly-opposed piston engines, which have two opposed rows of cylinders, and both cylinders of each opposed pair of cylinders fire simultaneously.

2. Description of Prior Art

Piston engines for general aviation include horizontally opposed cylinder types. The present invention is an optimization of this general form. Prior examples of horizontally opposed internal combustion engines include U.S. Pat. No. 688,349 (Scott and Conney, 1901), U.S. Pat. No. 2,234,900 (Jones, 1941), U.S. Pat. No. 2,253,490 (Bakewell, 1941), U.S. Pat. 4,413,705 (Inaga, 1983). A present example of this general type of engine is the Lycoming turbo-charged 380 horsepower engine.

SUMMARY OF THE INVENTION

Aircraft engines require especially high reliability and long service life. They also need a high power-to-weight ratio, fuel efficiency, and a low frontal cross-section to minimize drag. They also must be practical to service routinely and overhaul periodically. The need for maintenance over a long service life is partly due to strict maintenance schedules prescribed by aviation regulators such as the U.S. Federal Aviation Administration. It is also due to the long life of an average aircraft, which is much longer than that of personal cars and trucks. Optimizing an engine for the above requirements is the goal of this aircraft engine design.

The objective of the invention is provision of a piston engine with evolutionary improvements over the prior technology in long-term reliability, serviceability, power to weight ratio, stability of combustion, and reduced manufacturing cost. The following features achieve these objectives:

1. Each cylinder is an individual part, and is a simple solid of rotation, having no ports or bolt holes.
2. The cylinders have air-cooling fins.
3. The cylinders are made of a single material such as iron for optimum reliability and longevity, as opposed to aluminum cylinders with a bore hardening treatment or steel sleeves.
4. The cylinder heads and crankcase are made of a second material, such as aluminum, for reduced weight.
5. Each cylinder head covers only two adjacent cylinders. This modularity enables partial engine disassembly for repair, and enables piston and cylinder reconditioning without a lift winch.
6. The cylinder heads are water-cooled.
7. The crankcase, cylinders, and cylinder heads are assembled with only one bolt per two cylinders, as later explained.
8. Each opposed pair of pistons is powered simultaneously, and is connected to the crankshaft 180 degrees apart for symmetric cranking force.
9. The engine components and accessories are optimized spatially for overall accessibility. This includes providing one camshaft below the crankshaft, and the other camshaft above it, to reduce crowding.

No prior engine has this optimum combination of features.

BRIEF DESCRIPTION OF THE DRAWINGS

FIG. 8 is a perspective view of the crank of FIGS. 5–7 with pistons attached.

FIG. 9 is a firing order table for the crank of FIG. 8.

FIG. 10 is a front transparent view of the crank of FIG. 8.

FIG. 11 is a perspective view of an alternate crank design with pistons attached.

FIG. 12 is a firing order table for the crank of FIG. 11.

FIG. 13 is a front transparent view of the crank of FIG. 11.

REFERENCE NUMBERS

P1–P12. Pistons 1–12

C1–C12. Cylinders 1–12

1. Cylinder

5. Cylinder head

10. Air-cooling fins on cylinder

11. Piston

12. Piston connecting rod

13. Crankshaft

14. Crank

15. Crank bearing journal

16. Crankcase

17. Crankcase partition

18. Main bearing

19. Harmonic balancer

20. Crankshaft rotation

24. Intake valve

25. Exhaust valve

26. Valve rocker arm

27. Rocker arm compartment

Figure 1:
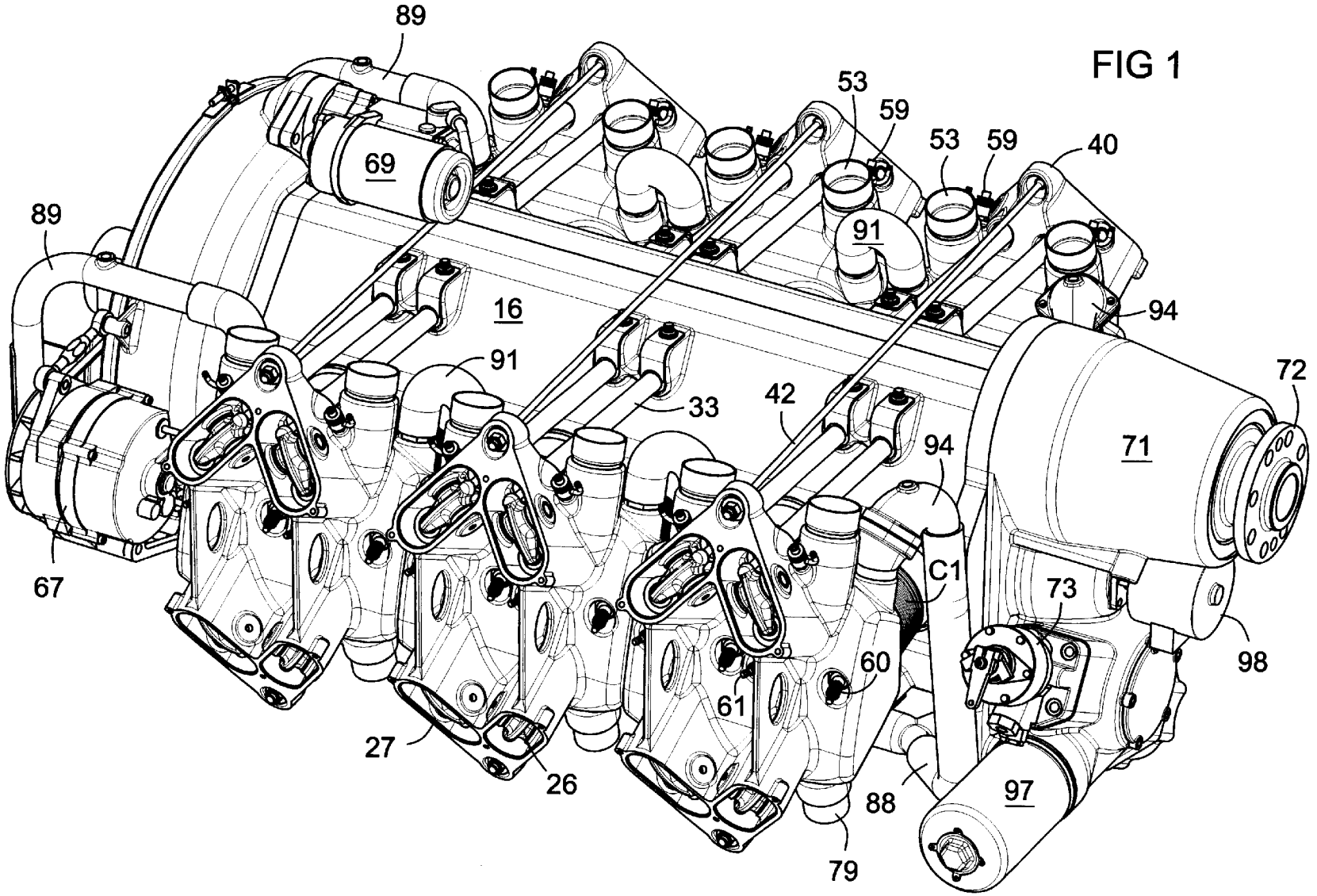
FIG. 1 is a right/front/upper perspective view of a 12-cylinder engine according to the invention, less intake, exhaust, and ignition lines, and valve rocker covers.
Figure 2:
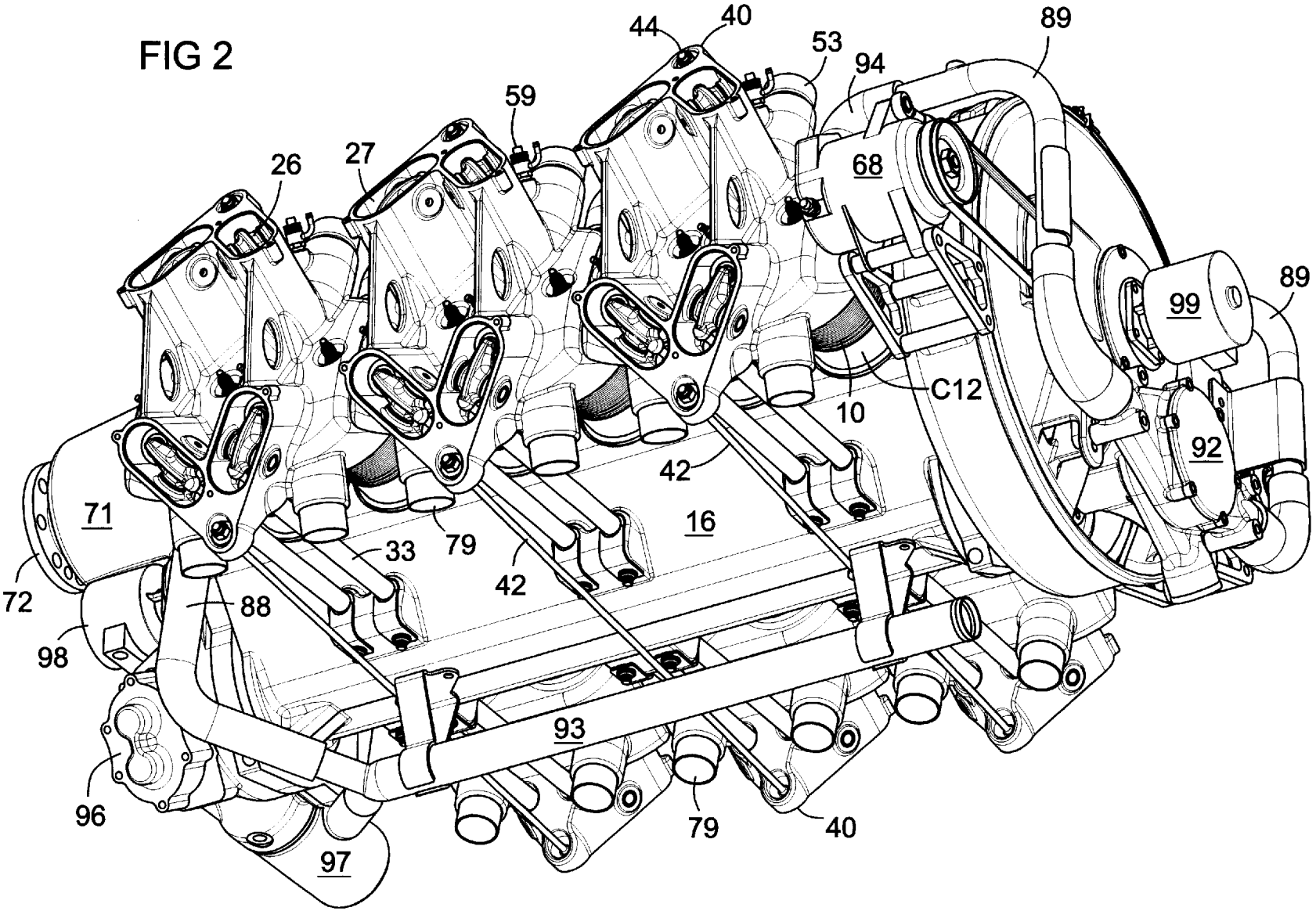
FIG. 2 is a left/rear/lower perspective view of FIG. 1.
Figure 3:
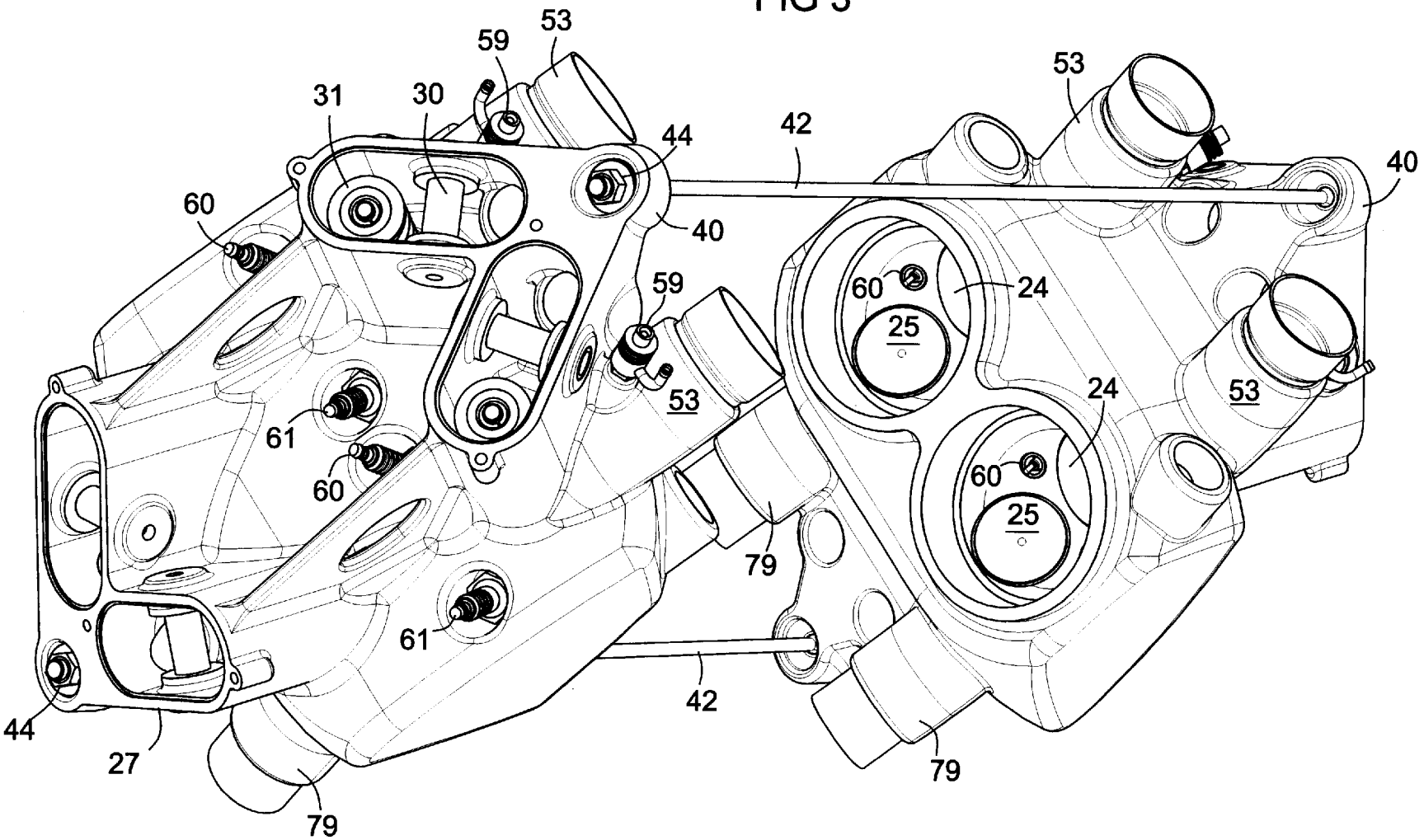
FIG. 3 is a perspective view of a 4-cylinder module showing only the cylinder heads and tie rods.
Figure 4:
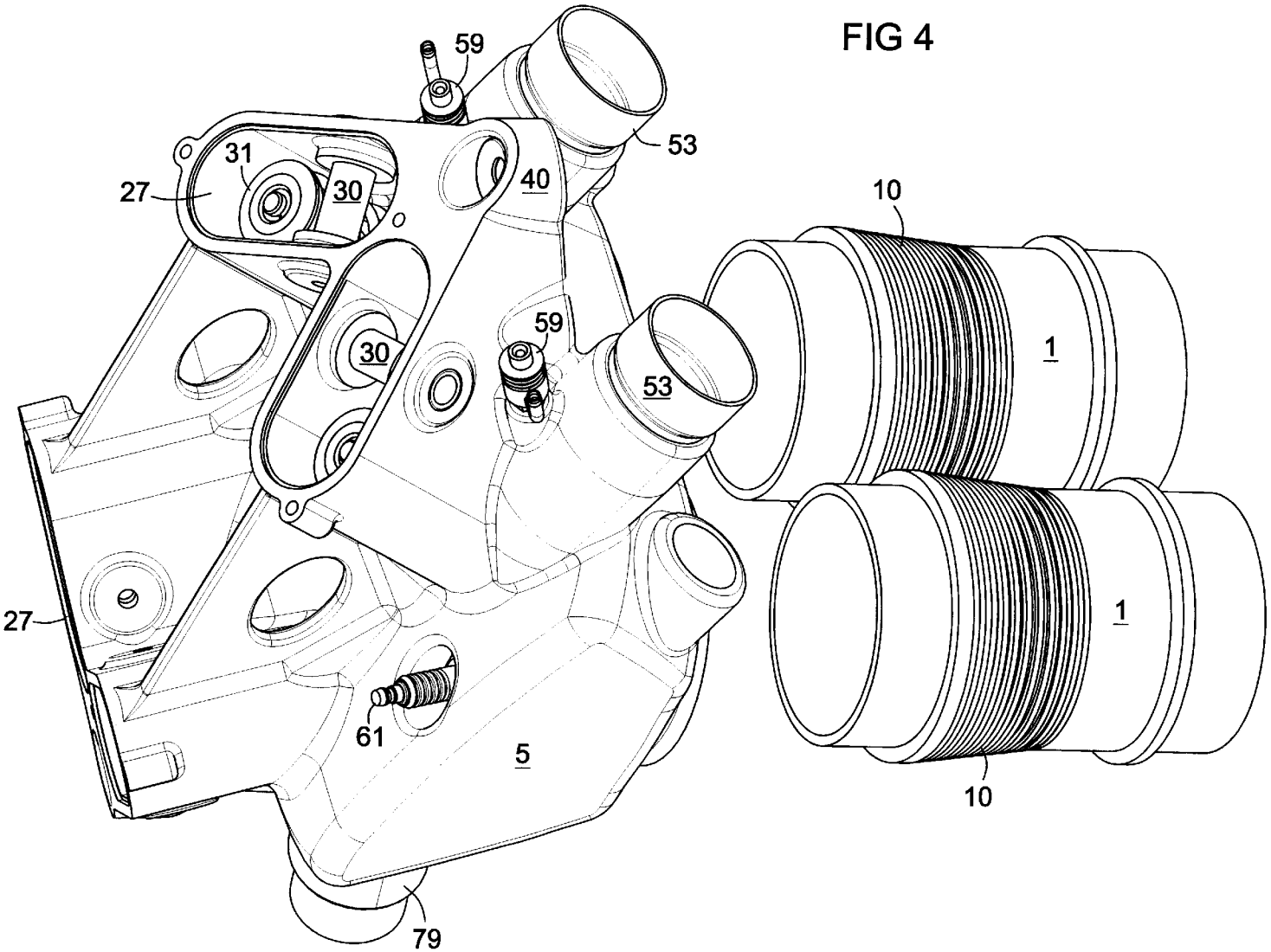
FIG. 4 is a perspective view of a cylinder head with cylinders exploded.
Figure 5:
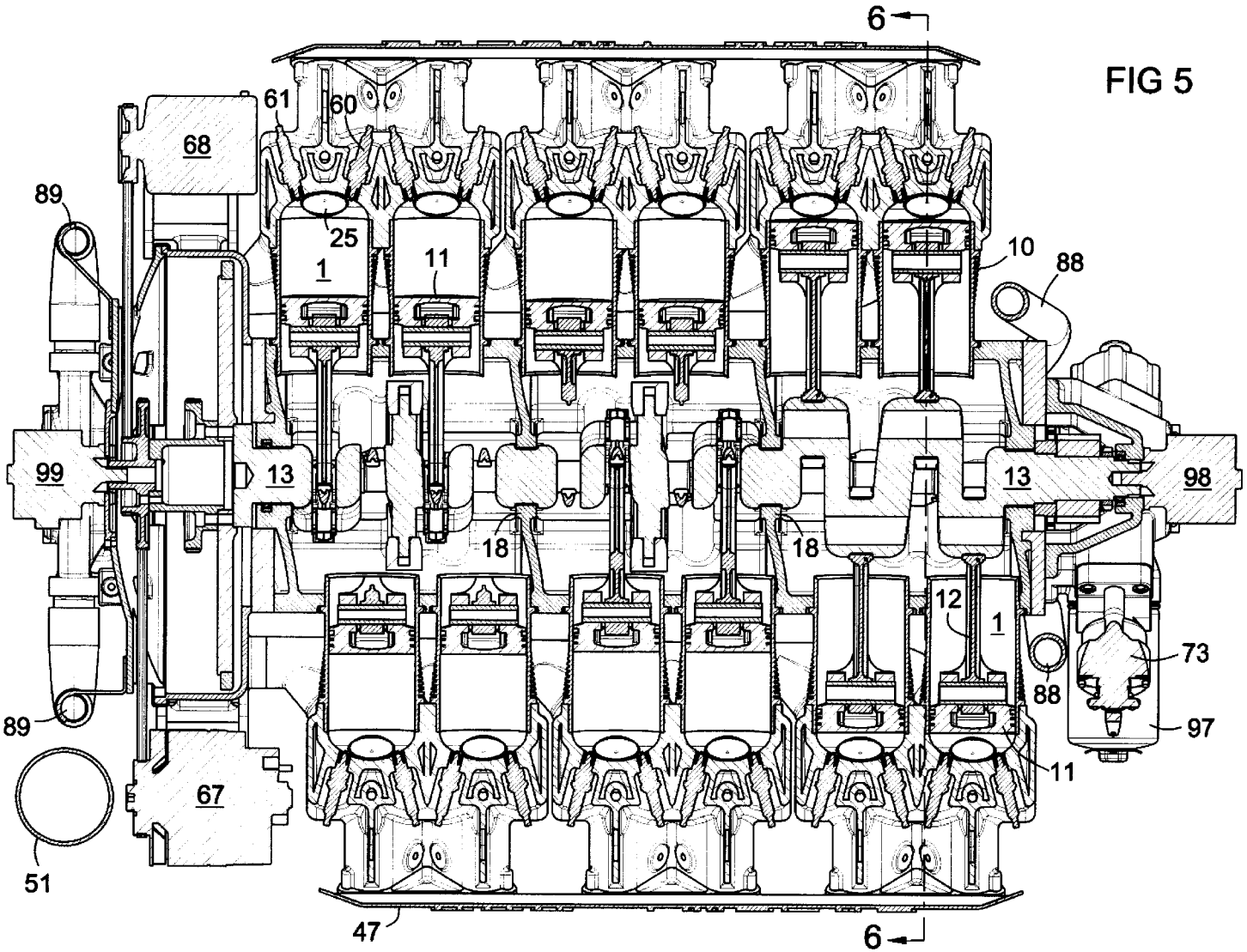
FIG. 5 is a top sectional view through the crankshaft axis of the engine of FIG. 1.
Figure 6:
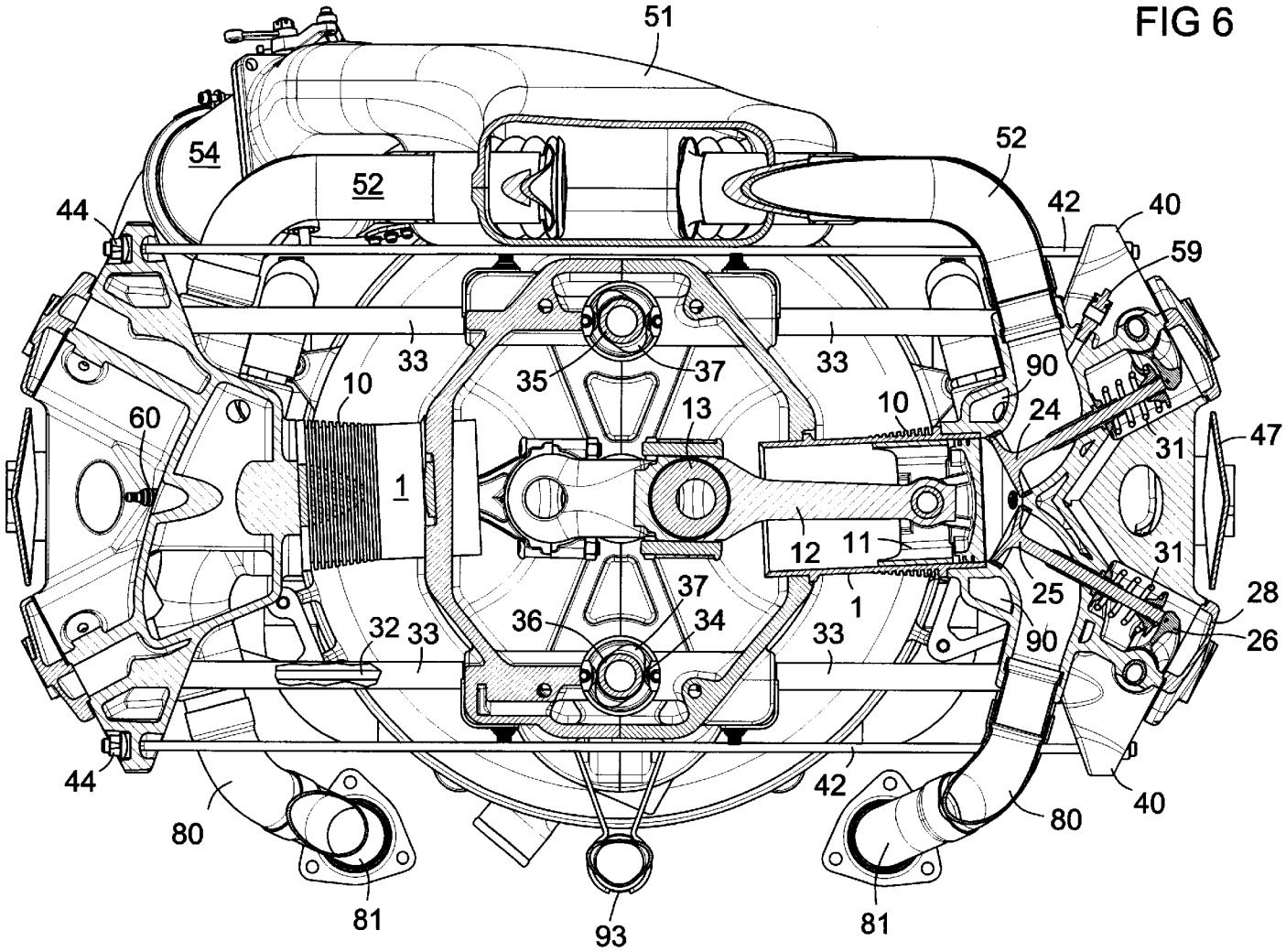
FIG. 6 is a front sectional view taken along line 6—6 of FIG. 5.
Figure 7:
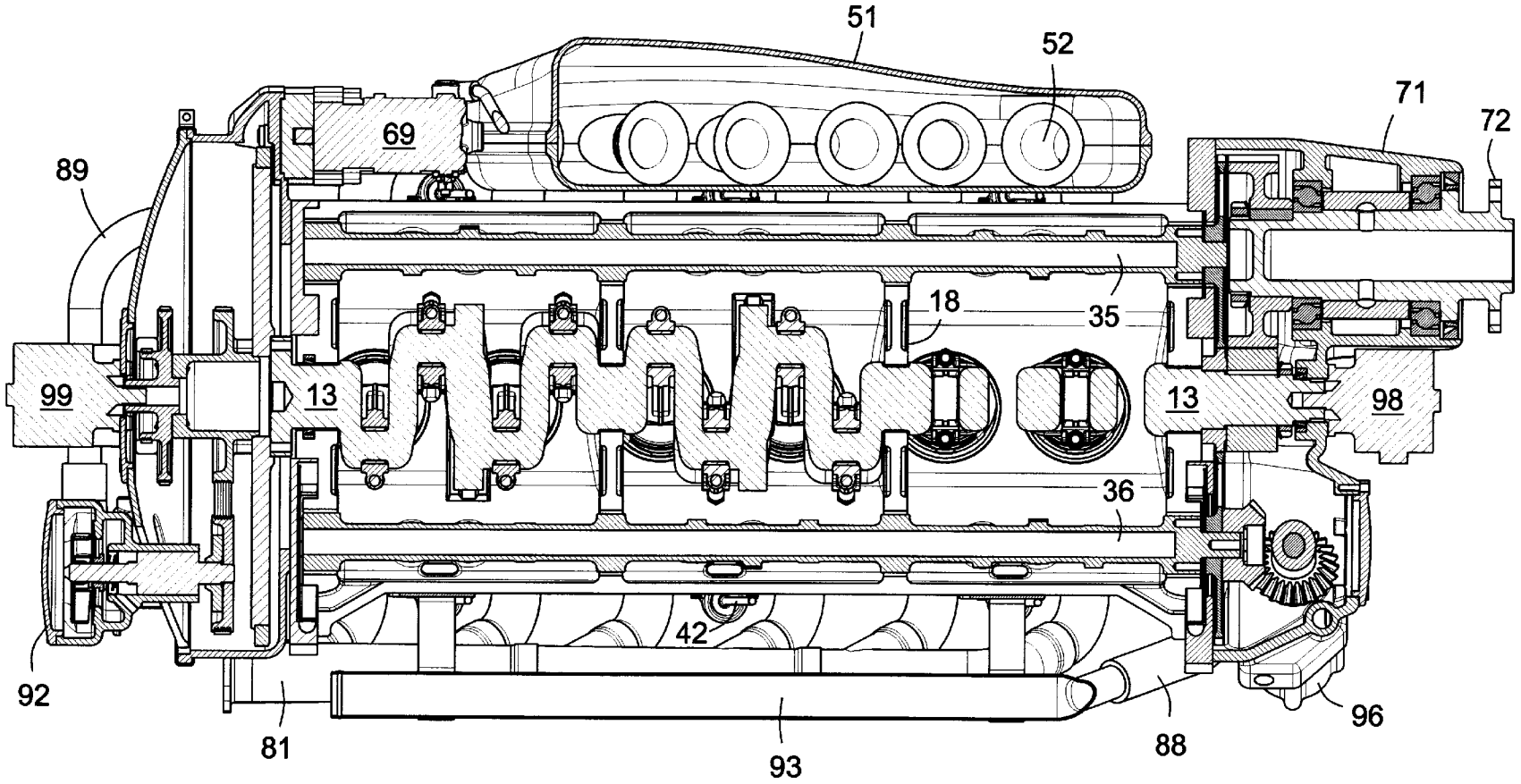
FIG. 7 is a right side sectional view taken through the crankshaft axis of FIG. 1.
Figure 14:
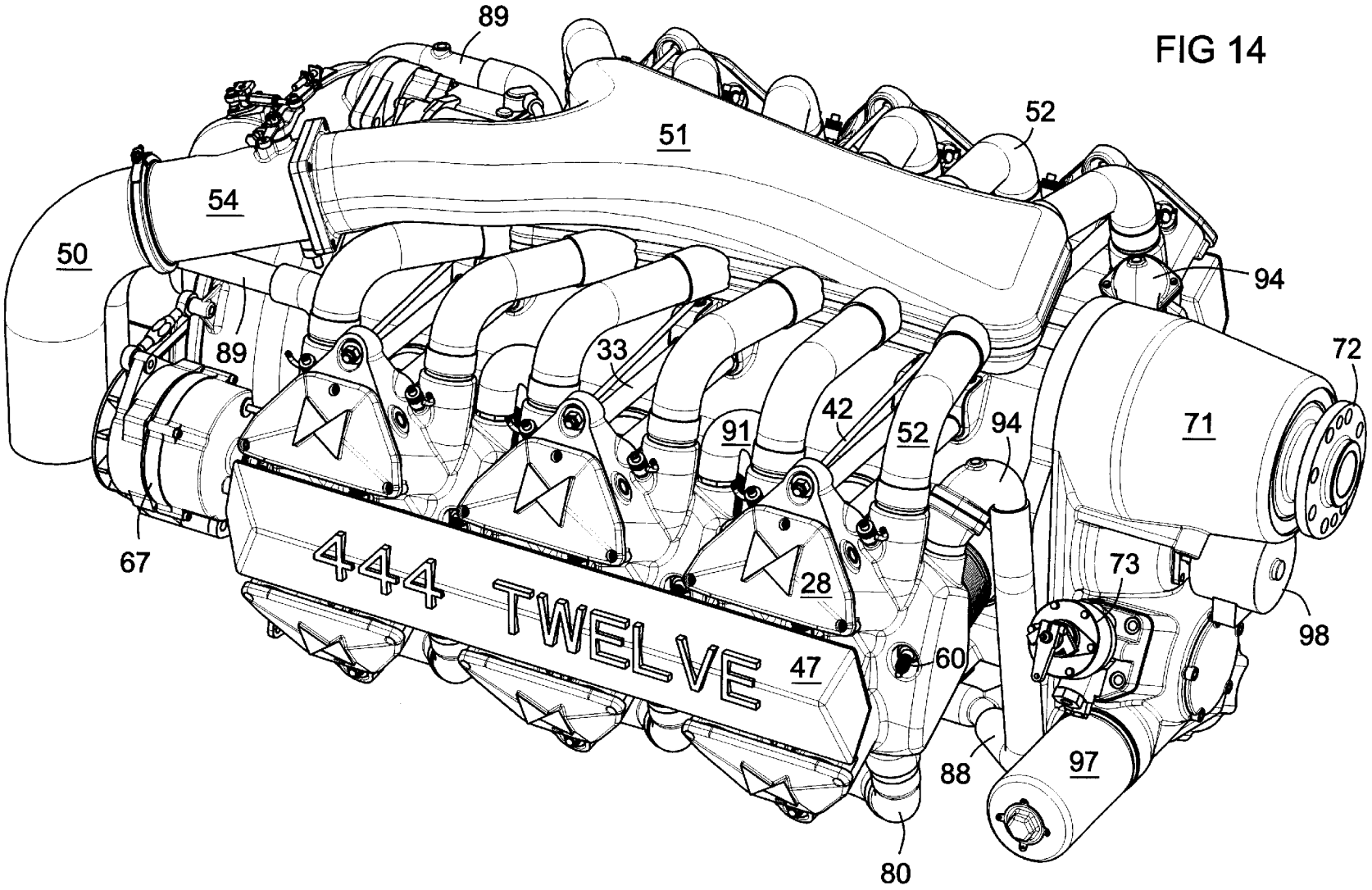
FIG. 14 is a right/front/upper perspective view of a fully assembled engine less ignition wires.
Figure 15:
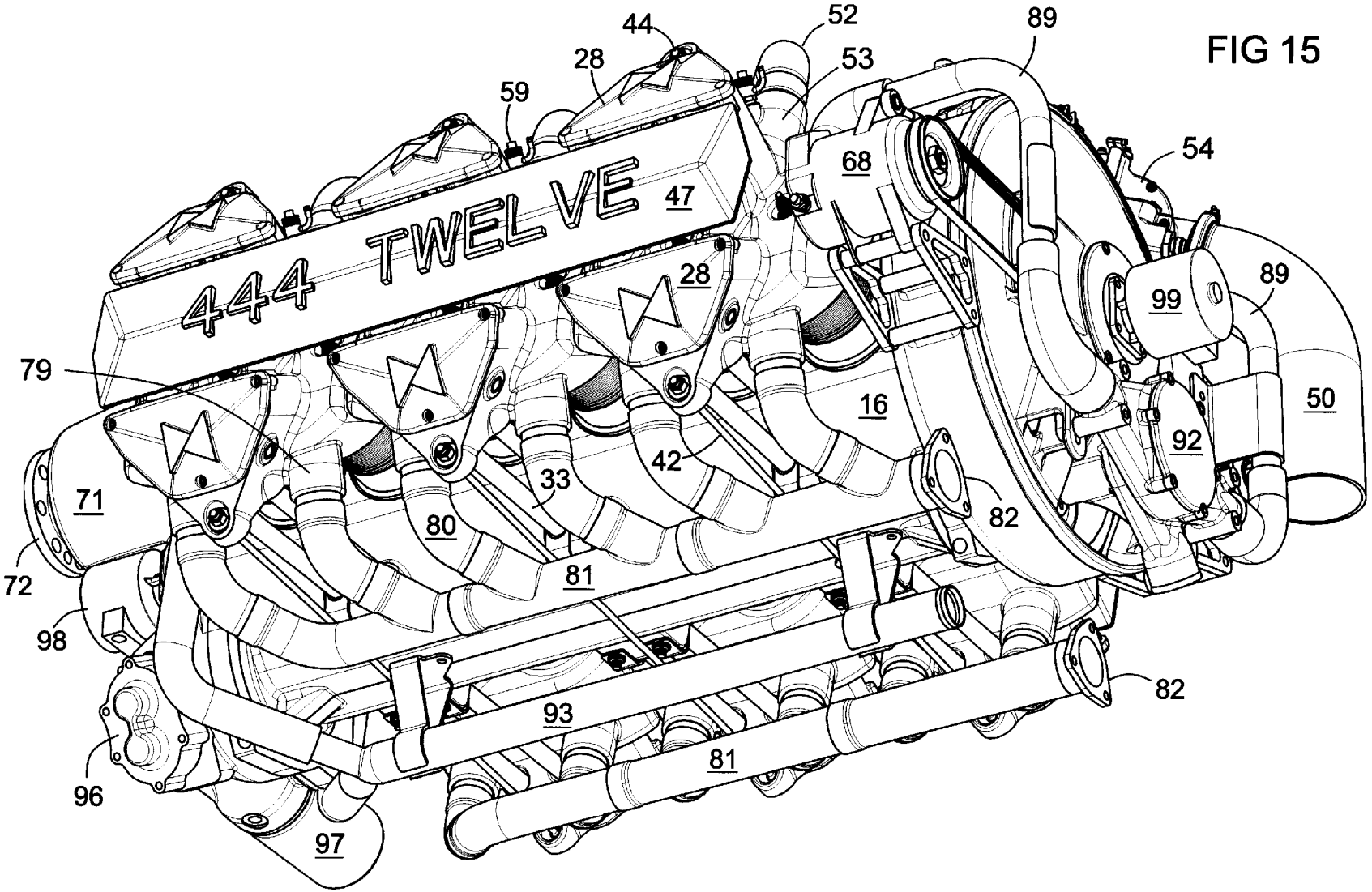
FIG. 15 is a left/rear/lower perspective view of a fully assembled engine less ignition wires.
Figure 16:
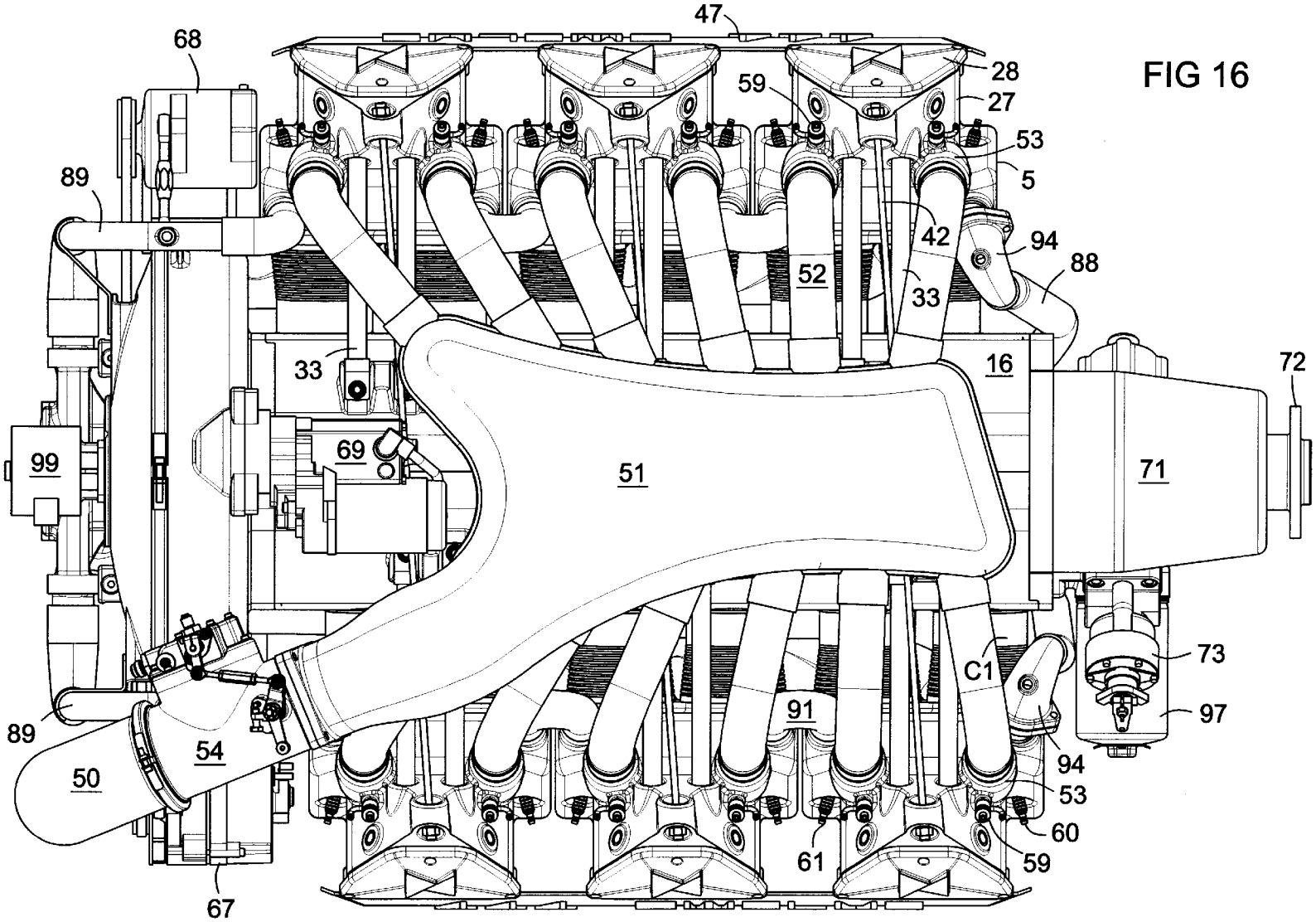
FIG. 16 is a top view of a fully assembled engine less ignition wires.
Figure 17:
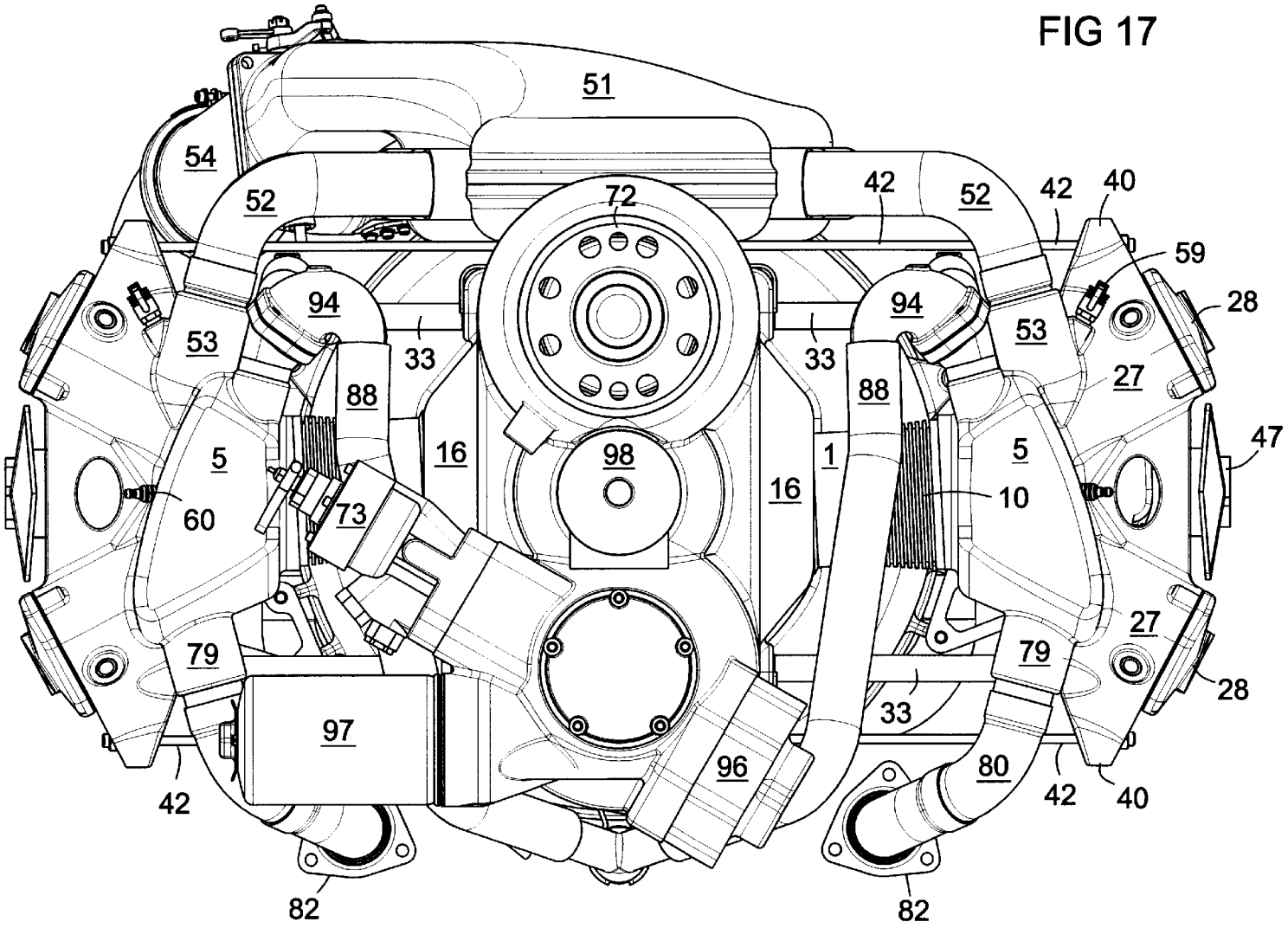
FIG. 17 is a front view of a fully assembled engine less ignition wires.
Figure 18:
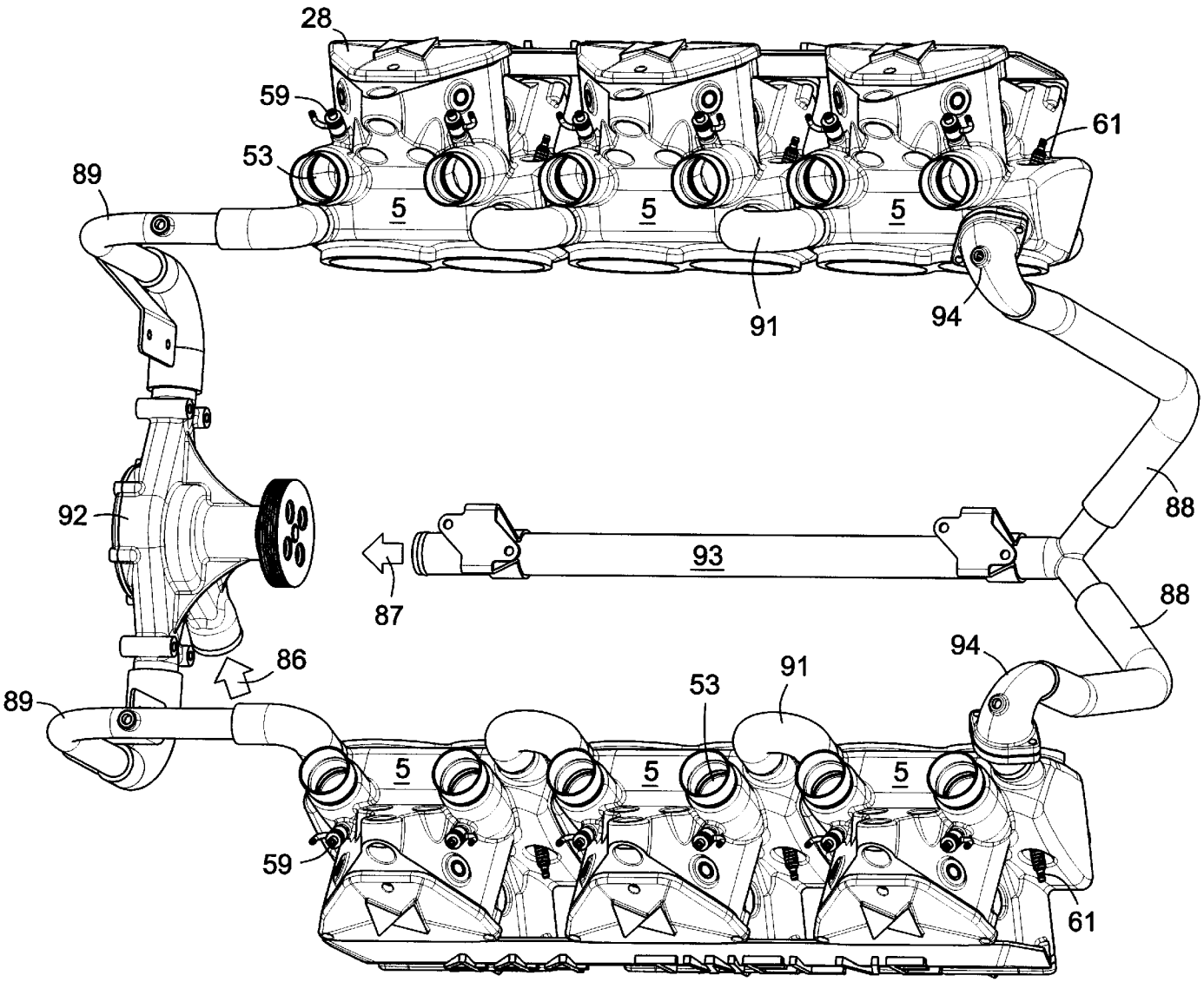
FIG. 18 is a perspective view of a liquid coolant system with cylinder heads.

28. Valve rocker cover
29. Valve rocker cover attachment nut
30. Valve rocker arm journal
31. Valve spring
32. Valve pushrod
33. Valve pushrod tube
34. Cam follower wheel
35. Intake or induction camshaft
36. Exhaust camshaft
37. Cam lobe
40. Tension rod boss
42. Tension rod or bolt
44. Tension rod nut
47. Ignition wire channel cover
50. Air intake pipe
51. Air intake plenum
52. Air intake runner
53. Fuel/air intake port
54. Throttle body
59. Fuel injector
60. First spark plug for a given cylinder
61. Second spark plug for a given cylinder
67. Alternator 1
68. Alternator 2
69. Starter
71. Propeller drive housing
72. Propeller mounting flange
73. Propeller governor
79. Exhaust port
80. Exhaust runner
81. Exhaust collector
82. Exhaust collector flange
86. Liquid coolant flow direction from radiator
87. Liquid coolant flow direction to radiator
88. Liquid coolant return hose
89. Liquid coolant supply pipe
90. Liquid coolant channel
91. Liquid coolant connecting tube
92. Liquid coolant pump
93. Liquid coolant return pipe
94. Thermostat housing
96. Oil pump
97. Oil filter
98. Vacuum pump 1
99. Vacuum pump 2
104. Solenoid
111. Timing disk on crankshaft, normally the flywheel
113. Crankshaft timing sensor
115. Ignition control unit (electronic distributor)
116. Manifold pressure sensor
117. Ignition wire
118. Dual ignition coil
119. Spark plug lead
122. Primary power bus
123. Secondary power bus

DESCRIPTION OF THE PREFERRED EMBODIMENTS

Preferred embodiments of the invention are shown in the attached drawings. FIG. 1 shows a top sectional view of a 12-cylinder internal combustion engine exemplifying the concepts of the invention. The cylinders are arranged in two horizontally opposed rows. Each pair of directly opposite cylinders fires simultaneously, and their pistons are connected to the crankshaft on adjacent cranks 180 degrees apart. This provides symmetric cranking force on the crankshaft, minimizing stress and vibration in the crankshaft and main bearings. The strength and weight requirements of the crankshaft, crankcase, and bearings are reduced accordingly.

Each cylinder is a separate part, which provides several advantages.

1) The cylinders can be made from a single durable material, preferably iron, while the remainder of the engine is another material, preferably aluminum, for reduced weight and heat transfer. This improves reliability and longevity as opposed to aluminum cylinders with internal sleeves or coatings.
2) Maintenance is simplified, since individual cylinders can be removed for service or replacement.
3) Since the sides of each cylinder are fully exposed, the sides can be air cooled via fins.
4) The cylinders are inexpensive to manufacture.

The cylinders have no ports, bolt holes, or fluid channels, and are simple solids of rotation. This is made possible by the engine assembly technique later described. The simplicity of the cylinders makes them inexpensive and reliable. They have uniform thermal expansion characteristics, and no stress concentrations.

The cylinder heads are constructed in identical modules supporting two cylinders each. This simplifies manufacturing, assembly, and maintenance. Each cylinder head covers the outer ends of two adjacent cylinders. Thus, in the 12-cylinder engine shown, there are six cylinder heads. The cylinder heads are preferably made of aluminum, and are small and light enough to be handled manually without a winch. The cylinder heads are water-cooled, providing a cooler engine with less temperature variation during operation than an air-cooled engine. This results in more stable combustion and less thermal expansion of engine components, giving dependable operation in all weather, and a long service life. Each head has one or more internal fluid channels for cooling. Fluid tubes span adjacent cylinder heads, forming a continuous coolant communication path through each of the two rows of cylinder heads.

The cylinder heads are held inward against the cylinders by tension bolts. Each pair of opposed cylinder heads has two tension bolts spanning between them. One tension bolt spans over the crankcase, and one bolt spans below it. Since two tension bolts hold each opposed pair of cylinder heads, and each cylinder head holds two cylinders, there is a ratio only 1 bolt for every two cylinders. This makes engine assembly and disassembly exceptionally simple. The cylinder head distributes the force of the two tension bolts evenly and centrally over the two retained cylinders. This assembly technique has several advantages:

1) The crankcase and cylinders are only stressed in compression. This allows reduced weight of these parts.
2) The engine can be quickly assembled and disassembled.
3) There are no bolt holes in the cylinders, reducing their expense, and eliminating stress concentrations.
4) Specializing the materials and engine parts appropriately to each task reduces the weight of the engine and increases its reliability. The bolts are specialized for tensile stress, while the cylinders and crankcase only need to support compression.

Firing of the cylinders is preferably done by an ignition system with a step-up transformer for each pair of opposed cylinders. Each transformer has one primary winding and two secondary windings. Each secondary winding fires a spark plug in one of the two opposed cylinders, causing them to fire simultaneously. The preferred embodiment of the engine has two independent ignition systems, offering full redundancy for maximum fail-safe operation in aircraft, as is known in the art. There are two alternators and two complete sets of coils firing two spark plugs per cylinder. If one ignition system fails at any point in the system, the other ignition system continues to fully operate the engine.

Two versions of the crankshaft are shown. In the first embodiment of FIGS. 8–10, pistons P1 and P2 are opposed, and fire simultaneously. Pistons P3 and P4 have the same crank positions as P1 and P2 respectively, but fire 360 degrees apart from P1 and P2. Thus, pistons P1 and P2 fire on alternate strokes from pistons P3 and P4 in the 4-stroke cycle of the engine. Pistons P5–P8 are arranged similarly to P1–P4, but are offset 120 degrees from P1–P4. Pistons P9–P12 are offset another 120 degrees. Thus, a power stroke occurs simultaneously on two opposite pistons every 120 degrees. In the preferred 12-cylinder engine size, this provides smooth, symmetric cranking force on the crankshaft. Harmonic balancers 19 damp torsional resonance in the crankshaft.

A second crankshaft embodiment is shown in FIGS. 11–13. Again, opposite cylinders fire simultaneously. However, the pairs of opposed cylinders are offset from each other in a timing sequence of 105, 135, 105, 135, . . . degrees. This is the preferred embodiment, because it reduces torsional resonance in the crankshaft to the extent that harmonic balancers are not needed, thus reducing weight. Rearrangement of the order of this configuration is possible. For example pistons P3–P4 can be offset either 105 or 135 degrees from P1–P2, and pistons P5–P6 are then offset 135 or 105 degrees respectively from P3–P4. The essential feature is that each opposed pair of cylinders is offset from the other pairs in a timing sequence that varies a given amount within a range of 10–30 degrees on alternating sides of 120 degrees. 15 degrees is the preferred variation from 120.

An ignition system schematic diagram is provided for each of the two crankshaft embodiments shown. The ignition system of FIGS. 19A and 19B correspond to the crankshaft and timing diagrams of FIGS. 8–10. The ignition system of FIGS. 20A and 20B correspond to the crankshaft and timing diagrams of FIGS. 11–13. The ignition control units (ICUs) in these diagrams are electronic distributors that receive timing inputs from sensors located around a timing disk on the crankshaft, as is known in the art. The ignition system diagrams shown herein are configured around ICUs available as of this writing from Light Speed Engineering Incorporated. These units accept three timing input signals and provide three electrical outputs to the spark coils. However, other configurations are logically possible. For example, in FIG. 19B, only one ICU with 3 inputs and 6 outputs is logically needed for each power bus. For another example, in FIG. 20B, only one ICU with 6 inputs and 6 outputs is logically needed per power bus. Each input signal produces a corresponding output on each 360-degree rotation of the crankshaft. In the 4-stoke cycle of the engine, this causes a spark to occur at the top of compression, and a second spark to occur at the top of exhaust, the latter spark being wasted, as is known in the art. The wasted spark is not useful, but occurs naturally when timing from the crankshaft, which is done for practical reasons. Other timing sources, such as the camshaft, can be used if desired.

Figure 19A:
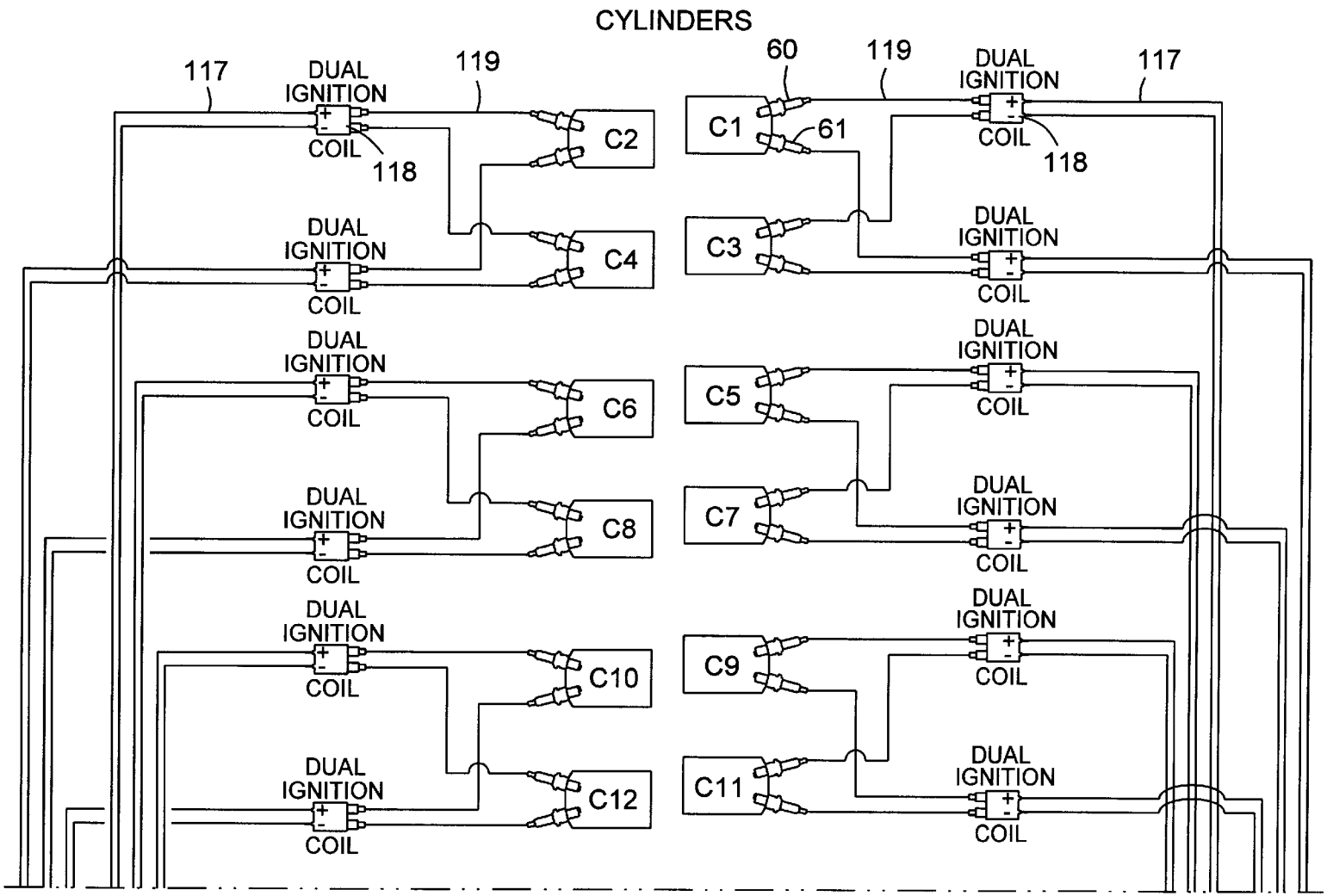
FIG. 19A Part A of ignition system schematic diagram corresponding to FIGS. 8–10.
Figure 19B:
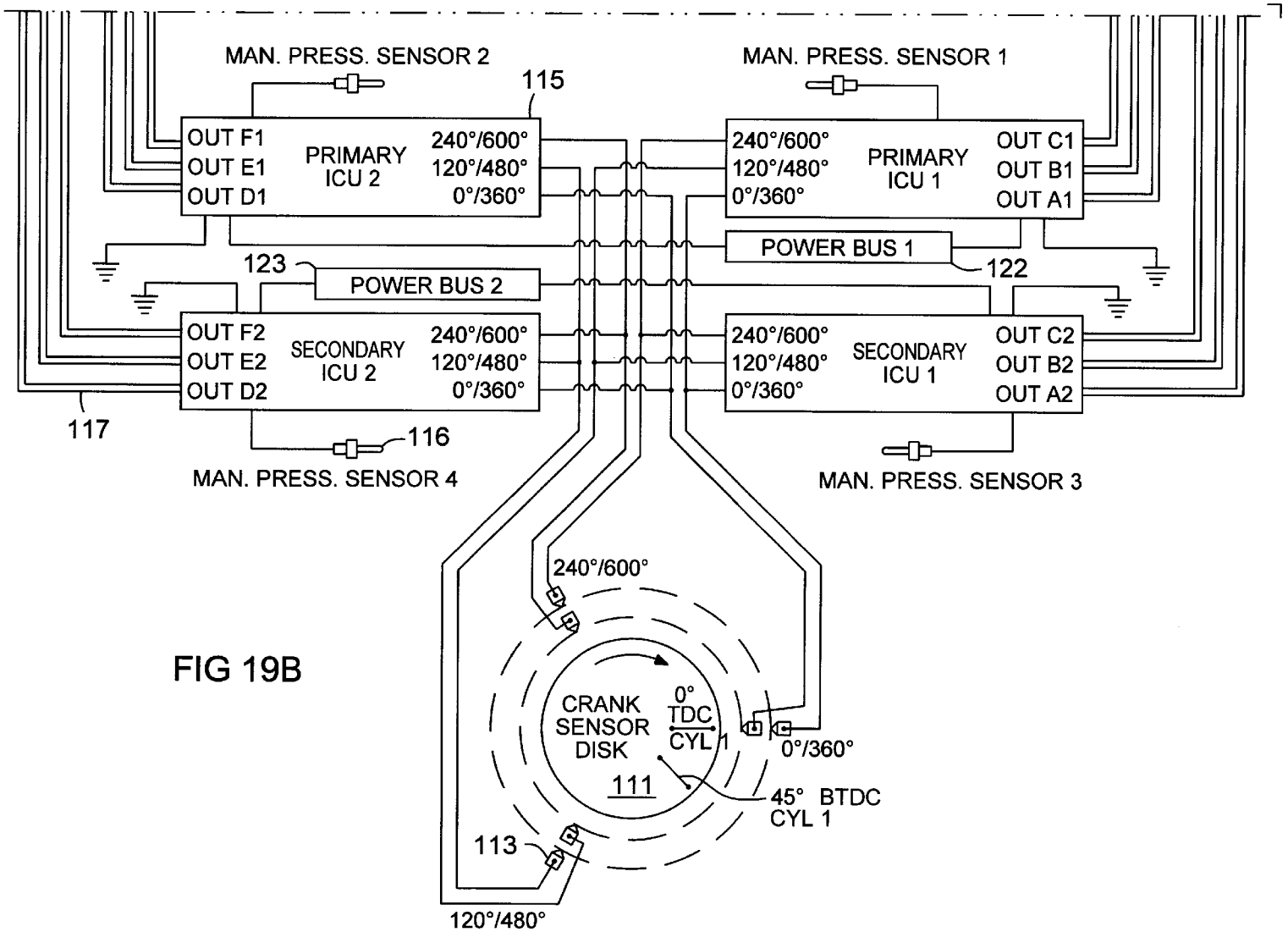
FIG. 19B Part B of ignition system schematic diagram corresponding to FIGS. 8–10.

In the ignition system of FIGS. 19A and 19B, adjacent pairs of opposed cylinders in each module fire 360 degrees apart. In the first module, comprising cylinders 1–4, cylinders 1 and 2 fire together, then cylinders 3 and 4 fire 360 degrees later. Sparks are supplied to each of these 4 cylinders at both 0.0 degrees and at 360 degrees by both the primary and secondary ignition systems. Alternate sparks in each cylinder are wasted or idle, not causing ignition. The configuration of FIGS. 19A and 19B avoids spark plug wires crossing over the engine.

Figure 20A:
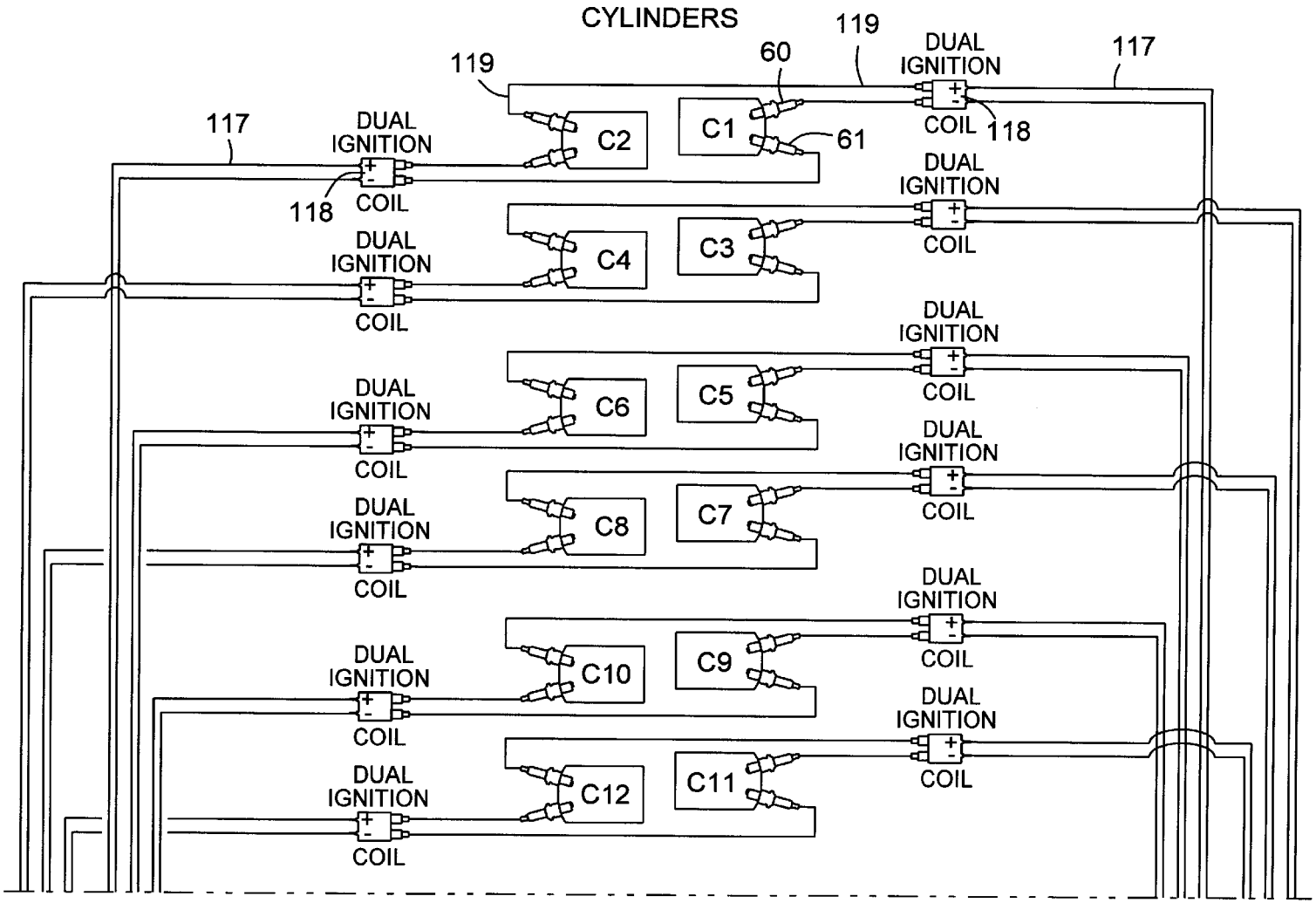
FIG. 20A Part A of ignition system schematic diagram corresponding to FIGS. 11–13.
Figure 20B:
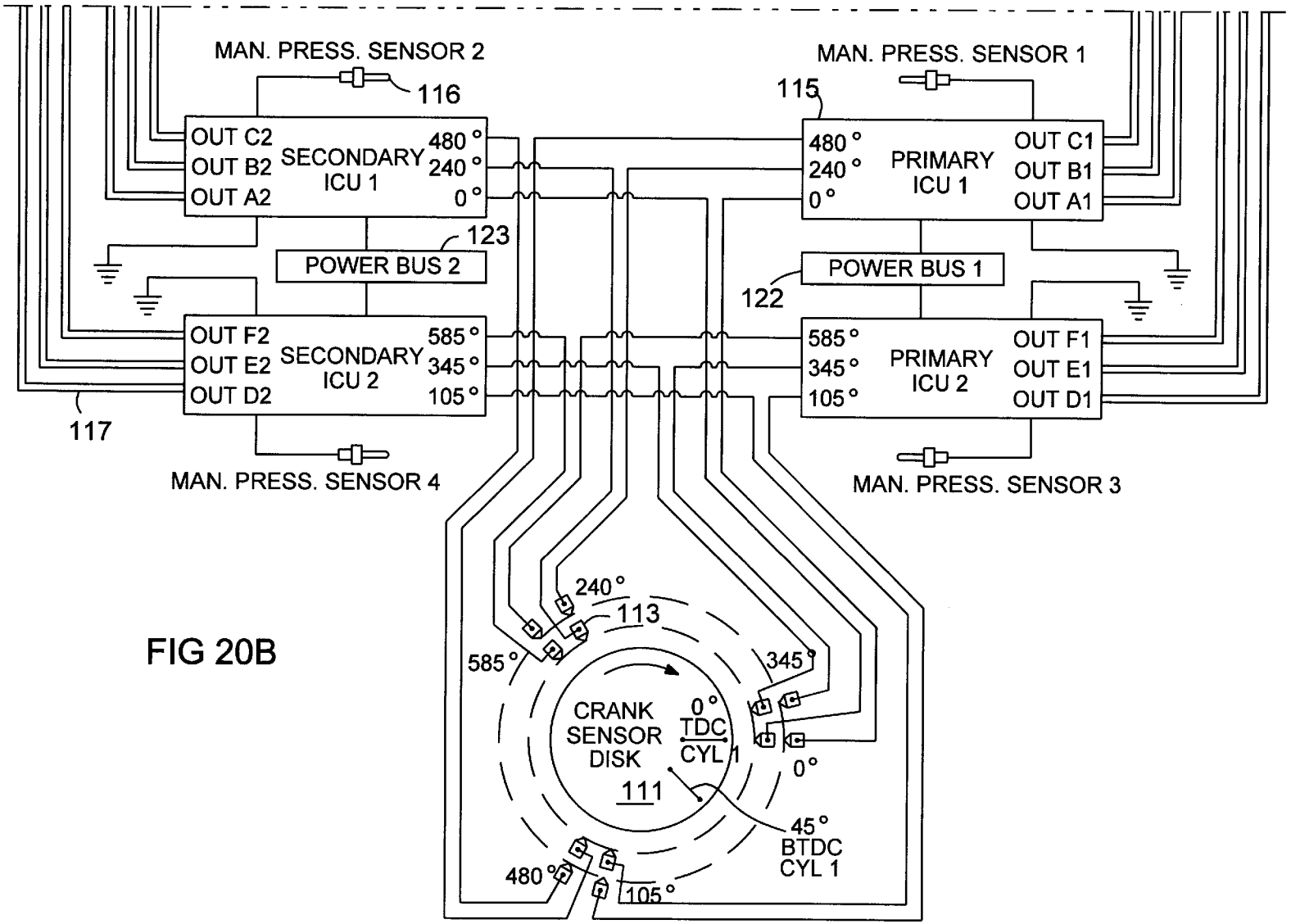
FIG. 20B Part B of ignition system schematic diagram corresponding to FIGS. 11–13.
Figure 21A:
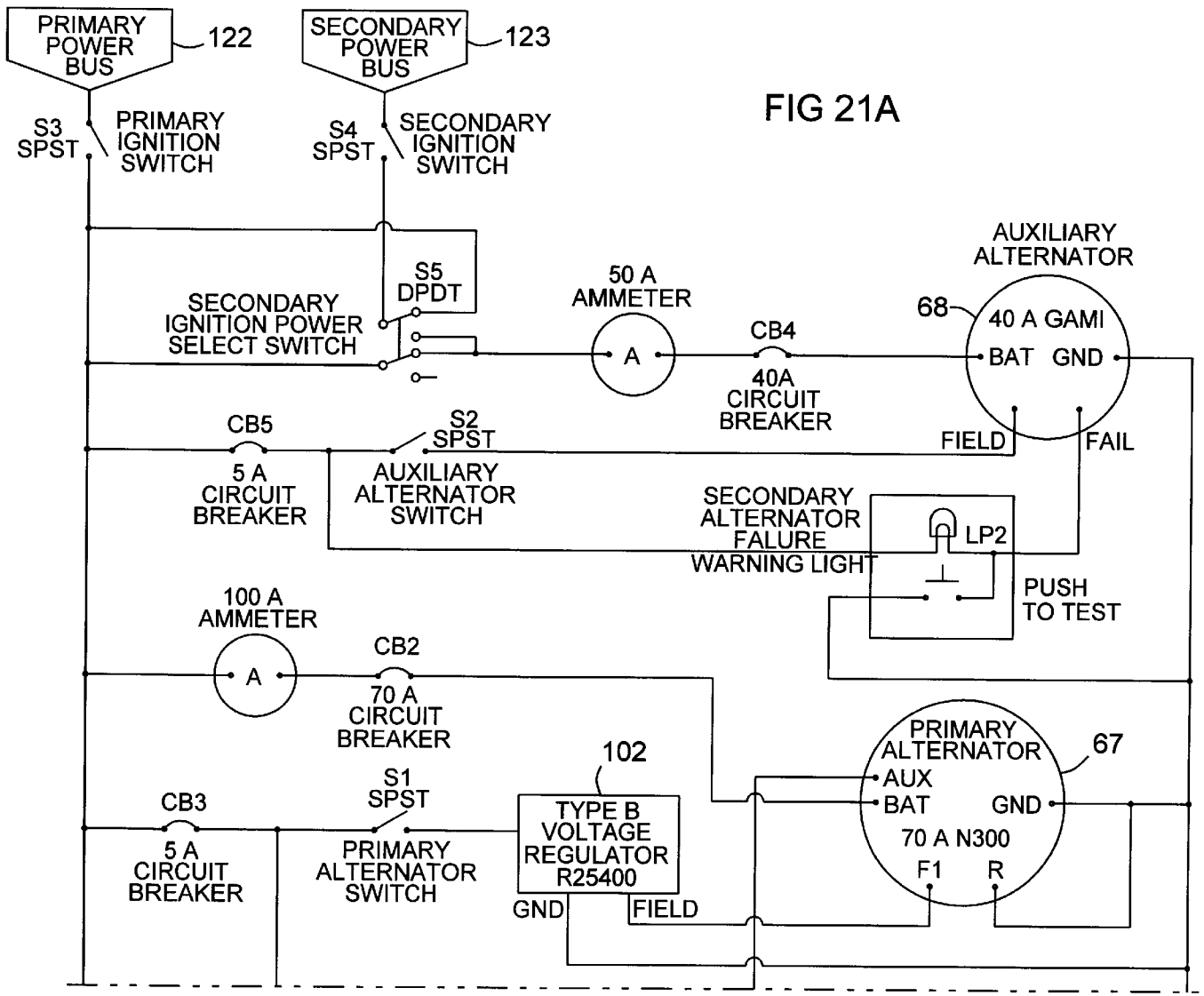
FIG. 21A Part A of overall electrical system schematic diagram
Figure 21B:
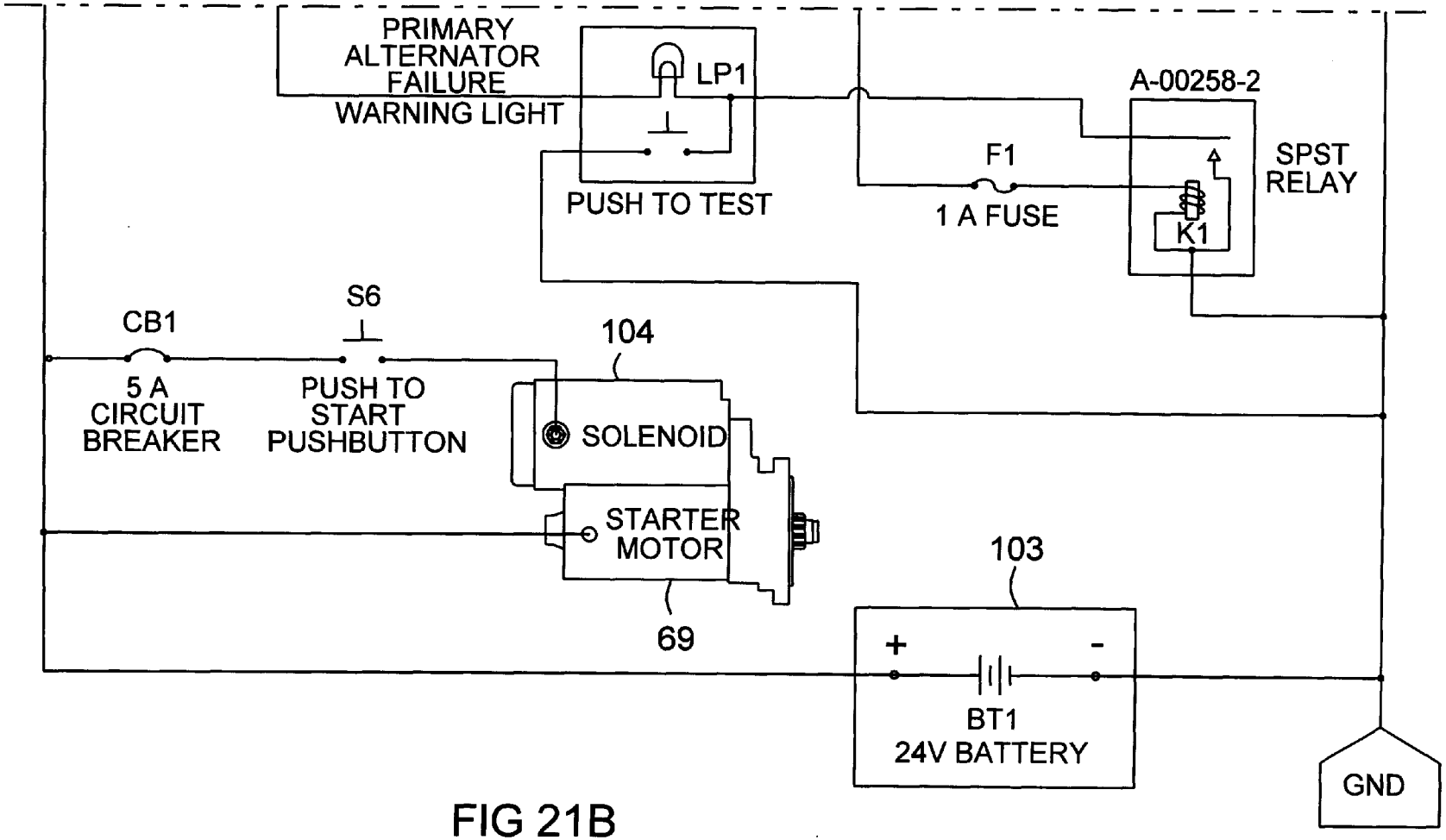
FIG. 21B Part B of overall electrical system schematic diagram

In the ignition system of FIGS. 20A and 20B, the timing separation between pairs of opposed cylinders is offset from the normal 120 degrees by approximately plus or minus 15 degrees. In the example shown, cylinders 3 and 4 have a timing separation from cylinders 1 and 2 of 105 degrees, which is 120 minus 15 degrees. Cylinders 5 and 6 have a timing separation from cylinders 3 and 4 of 135 degrees, which is 120 degrees plus 15 degrees. The offsets alternate plus and minus, so the timing separation averages 120 degrees. The offsets greatly reduce torsional harmonic vibrations in the crankshaft, so harmonic dampers on the crankshaft are not needed. The offsets could be reversed, with cylinders 3 and 4 separated from cylinders 1 and 2 by 135 degrees, and cylinders 5 and 6 separated from cylinders 3 and 4 by 105 degrees.

A major design goal is accessibility to all areas of the engine for service and disassembly. Clutter is reduced by locating one camshaft above the crankshaft and another camshaft below the crankshaft. Each camshaft supports a series of cam lobes 37 for opening and closing intake or exhaust valves at the proper times. Each cam lobe is followed by a wheel 34, which operates a pushrod 32 that spans between the crankcase and a cylinder head to operate a rocker arm 26 in the cylinder head. The pushrods are encased in protective tubes 33, which also return oil from the cylinder head to inside the crankcase.

When using the crankshaft of FIGS. 8–10, the intake and exhaust camshafts only need three cams each per 4-cylinder module. This is because adjacent pairs of opposed cylinders in each module fire 360 degrees apart, so a cam located between these two pairs of cylinders can provide timing to two cam followers on opposite sides of the camshaft for two of the cylinders. However, where adjacent opposed pairs of cylinders do not fire 360 degrees apart, this reduction of cams is not possible. The above-described consolidation of cams is optional in any case.

There is no coolant communication between the cylinders and cylinder heads because the cylinders are air-cooled. In the event of a head gasket failure there is no possibility of loosing coolant, and no possibility of coolant leaking into the oil. The gaskets at each end of the cylinder are simple rings, reducing their likelihood of damage or distortion during assembly.

The cylinders are inexpensive, and engine assembly is simple and modular. This allows the cylinders to be smaller and more numerous without increasing the cost of the engine. This in turn allows a smooth-running engine with paired firings and symmetric cranking. Although a 12-cylinder engine embodiment is preferred, other numbers of cylinders are possible, in multiples of 4. Any engine components or systems not shown and described in detail here can be provided and adapted to this engine as known in the art.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

We claim:

1. An internal combustion engine comprising;

a crankcase having front and back ends, top, bottom, left and right sides;

a crankshaft having a longitudinal axis, the crankshaft mounted in the crankcase between the front and back ends of the crankcase;

a row of left cylinders mounted on the left side of the crankcase along a line parallel to the longitudinal axis of the crankcase;

a row of right cylinders mounted on the right side of the crankcase along a line parallel to the longitudinal axis of the crankcase;

each left cylinder having one generally opposed right cylinder;

each cylinder having an inner end against the crankcase, an outer end, and an axis;

each cylinder being substantially a simple solid of rotation with air cooling fins;

a row of left cylinder heads, each head covering the outer ends of two adjacent left cylinders;

a row of right cylinder heads, each head covering the outer ends of two adjacent right cylinders;

each of the left cylinder head generally opposed to one of the right cylinder heads;

each cylinder head connected to the generally opposed cylinder head by at least one tension bolt spanning between them above the crankcase, and at least one tension bolt spanning between them below the crankcase;

each cylinder head having at least one liquid cooling channel;

the cooling channel of adjacent cylinder heads in each row of cylinder heads inter-connected by tubes;

a piston slidably mounted in each cylinder;

the crankshaft having a crank for each piston;

each piston connected to the respective crank by a connecting rod;

an ignition system providing at least one electrical spark in each cylinder at specific repeating timing intervals;

each cylinder having simultaneous spark timing with the generally opposed cylinder.

2. The internal combustion engine of claim 1, comprising:

six left cylinders and six right cylinders, forming six pairs of said generally opposed cylinders;

the spark timing of each pair of the generally opposed cylinders separated from the spark timing of each of the other pairs of the generally opposed cylinders by multiples of 120 degrees of engine rotation.

3. The internal combustion engine of claim 1, comprising:

six left cylinders and six right cylinders, forming six pairs of said generally opposed cylinders;

a first of the six pairs of generally opposed cylinders having a spark timing representing 0.0 degrees of engine rotation; and each of the other five pairs of generally opposed cylinders offset from the first pair of generally opposed cylinders by an amount of engine rotation chosen from the set consisting of 240 degrees, 480 degrees, 105 degrees plus or minus 10 degrees, 345 degrees plus or minus 10 degrees, and 585 degrees plus or minus 10 degrees.

4. The internal combustion engine of claim 1, comprising:

six left cylinders and six right cylinders, forming six pairs of said generally opposed cylinders;

a first of the six pairs of generally opposed cylinders having a spark timing representing 0.0 degrees of engine rotation; and each of the other five pairs of generally opposed cylinders offset from the first pair of generally opposed cylinders by an amount of engine rotation chosen from the set consisting of 240 degrees, 480 degrees, 135 degrees plus or minus 10 degrees, 375 degrees plus or minus 10 degrees, and 615 degrees plus or minus 10 degrees.

5. The internal combustion engine of claim 1, further comprising first and second camshafts in the crankcase, each of the camshafts having an axis parallel to the crankshaft axis, the first camshaft mounted above the crankshaft, and the second camshaft mounted below the crankshaft.

6. An internal combustion engine comprising:

a crankcase having first and second ends, first and second sides, a top, and a bottom;

a crankshaft mounted through the crankcase between the first and second ends;

a plurality of engine modules mounted on the crankcase, each module comprising:

two adjacent pairs of cylinders, each pair of cylinders comprising first and second cylinders mounted on generally opposite sides of the crankcase;

each cylinder being a separate part that is substantially a simple solid of rotation, having first and second ends and an outer surface with air cooling fins, the first end of the cylinder contacting the crankcase;

first and second cylinder heads, each cylinder head covering the second ends of two adjacent cylinders of a given module on one side of the crankcase, each cylinder head having at least one internal coolant passage, at least one intake valve per cylinder, and at least one exhaust valve per cylinder, each cylinder head for two cylinders being a separate part;

a tension bolt spanning between the first and second cylinder heads above the crankcase, and a tension bolt spanning between the first and second cylinder heads below the crankcase, the tension bolts holding the two cylinder heads inward against the cylinders, and holding the cylinders inward against the crankcase, thus bracketing and retaining the 4 cylinders of one module against the crankcase;

each cylinder having an internal bore with a piston slidably mounted therein;

the crankshaft having a crank for each piston, the cranks for the first and second cylinders of each of the generally opposed pair of cylinders being diametrically opposed on the crankshaft, or 180 degrees apart in crank rotation;

each piston connected to the respective crank by a pivoting connecting rod; and the engine is assembled from two or more of said modules in sequence along the crankcase.

7. The internal combustion engine of claim 6, further comprising:

an induction camshaft mounted through the crankcase above and parallel to the crankshaft;

an exhaustion camshaft mounted through the crankcase below and parallel to the crankshaft.

8. The internal combustion engine of claim 6, further comprising an ignition system comprising:

first and second spark plugs for each cylinder, the spark plugs mounted in the cylinder heads;

first and second alternators;

the first alternator electrically connected to all of the first spark plugs by a first ignition timing and distribution system;

the second alternator electrically connected to all of the second spark plugs by a second ignition timing and distribution system;

the first and second ignition timing systems coordinated to provide simultaneous current pulses to all four spark plugs of each given pair of the generally opposed cylinders simultaneously at a selected time.

9. The internal combustion engine of claim 6, in which the cylinders are arranged as six left cylinders and six right cylinders, forming six pairs of generally opposed cylinders; and the spark timing of each pair of the generally opposed cylinders is offset from the spark timing of each of the other pairs of the generally opposed cylinders by multiples of 120 degrees of engine rotation.

10. The internal combustion engine of claim 6, in which the cylinders are arranged as six left cylinders and six right cylinders, forming six pairs of generally opposed cylinders; one of the six pairs of the generally opposed cylinders has a spark timing representing 0.0 degrees of engine rotation; and each of the other five pairs of the generally opposed cylinders is separated in ignition timing from said one pair of the generally opposed cylinders by a unique amount chosen from the set consisting of 240 degrees, 480 degrees, 120 degrees minus a particular offset in the range of 5 to 35 degrees, 360 degrees minus the particular offset, and 600 degrees minus the particular offset.

11. The internal combustion engine of claim 6, in which the cylinders are arranged as six left cylinders and six right cylinders, forming six pairs of generally opposed cylinders; one of the six pairs of the generally opposed cylinders has a spark timing representing 0.0 degrees of engine rotation; and each of the other five pairs of the generally opposed cylinders is separated in ignition timing from said one pair of the generally opposed cylinders by a unique amount chosen from the set consisting of 240 degrees, 480 degrees, 120 degrees plus a particular offset in the range of 5 to 35 degrees, 360 degrees plus the particular offset, and 600 degrees plus the particular offset.

12. The internal combustion engine of claim 6, wherein the crankcase and cylinder heads are made of a first material, and the cylinders are made wholly of a second material.

13. An internal combustion engine comprising:

a crankcase having first and second ends, first and second sides, a top and bottom;

a crankshaft mounted through the crankcase between the first and second ends;

a plurality of pairs of generally opposed cylinders mounted on the crankcase, each generally opposed pair of the cylinders comprising a first cylinder mounted on the first side of the crankcase, and a second cylinder mounted generally opposite the first cylinder on the second side of the crankcase;

each cylinder being a separate part that is substantially a simple solid of rotation, having first and second ends and an outer surface with air cooling fins, the first end of the cylinder contacting the crankcase;

a first cylinder head for each two adjacent cylinders on the first side of the crankcase, a second cylinder head for each two adjacent cylinders on the second side of the crankcase, each cylinder head covering the second ends of the respective two adjacent cylinders on one side of the crankcase, each cylinder head having at least one internal coolant passage, at least one intake valve per cylinder, and at least one exhaust valve per cylinder;

at least one tension bolt spanning between the first and second cylinder heads above the crankcase, and at least one tension bolt spanning between first and second cylinder heads below the crankcase, the tension bolts holding the two cylinder heads inward against the cylinders, and holding the cylinders inward against the crankcase, thus bracketing and retaining the cylinders against the crankcase;

each cylinder having an internal bore with a piston slidably mounted therein, each generally opposed pair of cylinders having a generally opposed pair of pistons therein;

the crankshaft having a crank for each piston, the cranks for the first and second cylinders of each of the generally opposed pair of cylinders being diametrically opposed on the crankshaft, or 180 degrees apart in crank rotation;

each piston connected to the respective crank by a pivoting connecting rod;

a first camshaft mounted through the crankcase above and parallel to the crankshaft; and a second camshaft mounted through the crankcase below and parallel to the crankshaft.

14. The engine of claim 13, further comprising:

an ignition distribution system with half as many output leads as engine cylinders, each output lead firing both cylinders of one of said pairs of generally opposed cylinders simultaneously via a dual output transformer;

an ignition timing signal provided to the ignition distribution system in a timing sequence starting at 0 degrees, in steps of 1440 degrees divided by the number of cylinders of the engine; and the two cranks of each generally opposed pair of pistons rotationally separated from the respective two cranks of the other generally opposed pairs of pistons in a firing order sequence matching the timing sequence;

whereby both cylinders of each generally opposed pair of cylinders fire simultaneously, and each generally opposed pair of cylinders is separated from the other generally opposed pair of cylinders in the timing sequence in steps of 1440 degrees divided by the number of cylinders in the engine.

15. The engine of claim 13, further comprising:

an ignition distribution system with half as many output leads as engine cylinders, each ignition distribution output lead on the first side of the engine firing two complementary cylinders on the first side of the engine every 360 degrees of engine rotation via a dual output transformer on the first side of the engine, each of the two complementary cylinders having a power stroke 360 degrees apart from the other of the two complementary cylinders, alternate sparks in each of the complementary cylinders being wasted;

the generally opposed cylinders to the two complementary cylinders receiving the same ignition timing as the complementary cylinders, via an ignition output lead on the second side of the engine and a dual output transformer on the second side of the engine;

an ignition timing signal provided to the ignition distribution system in a timing sequence starting at 0 degrees, in steps of 1440 degrees divided by the number of cylinders of the engine; and the two cranks of each generally opposed pair of pistons rotationally separated from the respective two cranks of the other generally opposed pairs of pistons in a firing order sequence matching the timing sequence;

whereby each of two cylinders on each side of the engine receive a spark simultaneously, and fire 360 apart.

16. The engine of claim 13, further comprising:

an ignition distribution system with half as many output leads as engine cylinders, each output lead firing both cylinders of one of said pairs of generally opposed cylinders simultaneously via a dual output transformer;

an ignition timing signal provided to the ignition distribution system in a timing sequence in steps of 1440 degrees divided by the number of cylinders of the engine plus a given offset on alternate steps of the timing sequence; and the two cranks of each generally opposed pair of pistons rotationally separated from the respective two cranks of the other generally opposed pairs of pistons in a firing order sequence matching the timing sequence;

whereby both cylinders of each generally opposed pair of cylinders fire simultaneously, and each generally opposed pair of cylinders is separated from the other pairs in the firing sequence in steps of 1440 degrees divided by the number of cylinders in the engine plus a given offset on alternate steps of the timing sequence to reduce harmonic vibrations in the crankshaft.

17. The engine of claim 13, further comprising:

an ignition distribution system with half as many output leads as engine cylinders, each output lead firing both cylinders of one of said pairs of generally opposed cylinders simultaneously via a dual output transformer;

an ignition timing signal provided to the ignition distribution system in a timing sequence in steps of 1440 degrees divided by the number of cylinders of the engine minus a given offset on alternate steps of the timing sequence; and the two cranks of each generally opposed pair of pistons rotationally separated from the respective two cranks of the other generally opposed pairs of pistons in a firing order sequence matching the timing sequence;

whereby both cylinders of each generally opposed pair of cylinders fire simultaneously, and each generally opposed pair of cylinders is separated from the other pairs in the firing sequence in steps of 1440 degrees divided by the number of cylinders in the engine minus a given offset on alternate steps of the timing sequence to reduce harmonic vibrations in the crankshaft.

* * * * *